US007052092B2

(12) United States Patent
Collinsworth et al.

(10) Patent No.: US 7,052,092 B2
(45) Date of Patent: May 30, 2006

(54) DRILLHOLE BLASTING

(76) Inventors: Stephen Mitchell Collinsworth, 839 Lower Hatchers Creek Rd., Stanton, KY (US) 40380; Nils Alberto Heinke, Route 1, Box 328.50, Elkins, WV (US) 26241; Roger Dean Skaggs, 7430 House Rd., Bonne Terre, MO (US) 63628

( * ) Notice: Subject to any disclaimer, the term of this patent is extended or adjusted under 35 U.S.C. 154(b) by 202 days.

(21) Appl. No.: 10/432,405

(22) PCT Filed: Nov. 19, 2001

(86) PCT No.: PCT/IB01/02184

§ 371 (c)(1),
(2), (4) Date: Oct. 9, 2003

(87) PCT Pub. No.: WO02/42711

PCT Pub. Date: May 30, 2002

(65) Prior Publication Data

US 2004/0099445 A1 May 27, 2004

(30) Foreign Application Priority Data

Nov. 21, 2000 (ZA) ..... 2000/6809

(51) Int. Cl.
*F24D 1/08* (2006.01)
*E21C 37/16* (2006.01)

(52) U.S. Cl. ..... 299/13; 102/333

(58) Field of Classification Search ..... 299/13, 299/14, 95; 102/333
See application file for complete search history.

(56) References Cited

U.S. PATENT DOCUMENTS

| | | | | |
|---|---|---|---|---|
| 351,273 | A * | 10/1886 | Learnard | 102/333 |
| 465,410 | A * | 12/1891 | Knox | 102/333 |
| 2,164,690 | A * | 7/1939 | Struzik | 102/333 |
| 5,035,286 | A | 7/1991 | Fitzgibbon, Jr. | |
| 5,803,172 | A | 9/1998 | Rajkovich | |

* cited by examiner

*Primary Examiner*—John Kreck
(74) *Attorney, Agent, or Firm*—Rutan & Tucker, LLP

(57) ABSTRACT

A blasting arrangement (10) includes drillholes (30) in a rock mass (20). Blind ends (32) are drilled to a desired level and, if necessary, are adjusted as shown at (62) to said level. Each hole (30) is plugged by means of a plug (42), which is protected by non flammable buffer material (44), at a level (40) spaced from the end (32). Explosive (50) is charged above the level (40) and the hole is tamped, shown at (60). The holes are detonated desirably by detonators (52), forcing the plugs (42) downwardly and compressing air in chambers (34) above the ends (32). The weakest part of each hole, around the end (32), is split causing a three dimensional zone of weakness at the level of the ends (32). Air forced into the zone of weakness causes a fracture zone (70) at that level, inhibiting propagation of blasting shock waves and protecting the material underneath the level of the ends (32).

23 Claims, 4 Drawing Sheets

DRILLHOLE BLASTING

This invention relates to blasting. In particular it relates to a method of blasting, to a drillhole arrangement, and to a blasting arrangement.

In accordance with a first aspect of this invention, there is provided a method of blasting a mass via a longitudinal drillhole into the mass and having a blind end at a predetermined longitudinal position in the mass, the method including concentrating the blast between a mouth of the drillhole and an area laterally around the drillhole at the longitudinal position of the blind end by creating, by blasting, a zone of weakness of lesser density than neighbouring material of the mass, the zone coinciding generally with said area and being of limited longitudinal extent.

More particularly, the first aspect relates to a method of blasting a mass including

- drilling a hole into the mass to have a blind end at a predetermined longitudinal position;
- obstructing the drillhole by means of a solid, movable obstruction at a position spaced from the blind end at a predetermined spacing;
- charging the drillhole with a blasting charge toward an end of the obstruction remote from the blind end;
- tamping the drillhole; and
- detonating the blasting charge, causing the obstruction to be driven toward the blind end.

Without wishing to be bound by theory, the Applicant believes that carrying out the method of the invention results in easily flowable matter below the obstruction being pressurized, which pressure propagates rapidly and with little or no attenuation along the portion of the drillhole between the obstruction and the bottom of the drillhole. The point or zone of least resistance is generally the periphery of the bottom of the drillhole, and fracturing takes place from that position. Thus, the portion of the drillhole below the obstruction is left vacant, i.e. is air-filled. The presence of an easily flowable substance such as water in "wet holes" does not detract from the efficacy of the invention.

The solid, movable obstruction has the characteristics of being solid in the sense of not passing or not easily passing the air (or water) but rather to contain and pressurize the air (or water); and of being movable along the drillhole. It thus acts as a plunger or piston.

The method of blasting may include providing a protective buffer between the obstruction and the blasting charge. Typically, a non-flammable material, such as drill cuttings, may be tamped into the drillhole to form the protection buffer.

The method may include the step of adjusting the blind end of the drillhole to a predetermined longitudinal position by backfilling the drillhole with a backfill material when it was drilled excessively deeply. Typically, the backfill material may be gravel, drill cuttings, or the life.

In accordance with a second aspect of this invention, there is provided a drillhole arrangement in a mass which includes

- a drillhole in the mass and having a blind end at a predetermined longitudinal position;
- a solid, movable obstruction which is spaced from the blind end;
- a blasting charge located to an end of the obstruction remote from the blind end; and
- tamping material obstructing a portion of the drillhole between the blasting charge and a mouth of the drillhole.

A spacing between the obstruction and the blind end may be between about 0.1 m and about 3 m.

The obstruction may be a moulding of a resiliently flexible polymeric material. It may be in the form of a plug. Instead, the plug may be in the form of a metal plate, a wooden obstruction, masonry, or any other blockage of the drillhole which is capable of serving as a plunger for pressurising the pressure chamber upon detonation of the charge of explosives.

Advantageously the drillhole arrangement may include a protective buffer located between the obstruction and the blasting charge. The protective buffer may be a layer of a non-flammable protective material, such as gravel, drill cuttings, or the like.

In a drillhole arrangement in which the drillhole was drilled excessively deeply and has an initial end beyond said predetermined longitudinal position, the arrangement may include a layer of backfill material against said initial end of the drillhole, so that a free end of the layer of backfill material proximate the obstruction effectively forms the blind end of the drillhole. The backfill material may be gravel, drill cuttings, or the like.

Sometimes, at least a portion of the drillhole between its blind end and the movable obstruction may be filled with a liquid, such as water. This is known in the field of the invention, as a wet hole. The presence of such liquid is not expected to have a detrimental effect. A suggested reason for this is that water, like air and unlike particulate material such as backfill, tamping material or the like, is easily flowable and thus allows high pressure to be generated below the solid, movable obstruction, and such pressure to be propagated substantially unattenuated to the bottom of the drillhole.

In accordance with a third aspect, there is provided a blasting arrangement which includes an array of spaced drillhole arrangements as herein described, with the blind ends of the drillholes lying on a predetermined interface between a part of the mass to be fragmented and a part of the mass which is to remain generally intact after detonation of the blasting charges.

In same blasting arrangements, the drillholes are substantially parallel and the predetermined interface may lie generally in a plane transverse to the drillholes. The drillholes may be substantially vertical, and the predetermined interface may be substantially horizontal or decumbent.

Furthermore, the predetermined interface may be generally parallel to and may be closely spaced from a bank of material which is to be left intact.

The predetermined interface may be located at a level corresponding to a level at which a desired bench floor is to be established during blasting.

The drillholes may be arranged in a grid-like configuration.

The blasting arrangement may be provided in an underground mining working.

The invention extends, generally, to a method of blasting a mass to fragment a part of the mass while leaving a remaining part of the mass generally intact, which method includes the step of establishing a zone of weakness of lesser density than neighbouring material of the mass, the zone being of limited longitudinal extent, coinciding generally with a desired interface between the part of the mass to be fragmented and the remaining part, and extending transversely to each of an array of spaced drillholes, so that the blast is concentrated between the zone and the mouths of the drillholes.

The invention extends yet further to a method of blasting which includes the steps of providing a blasting arrangement as hereinafter described, and detonating the blasting charge in each of the drillholes to displace each solid movable obstruction toward its associated blind end.

The drillholes may be substantially vertical, the part of the mass to be fragmented defining a substantially vertical free face facing a receiving cavity in the mass, and detonation of the blasting charges being progressively delayed with an increase in distance of each blasting charge from the free face, causing the part of the mass in which the blasting arrangement is provided to be cast towards the receiving cavity.

The invention extends also to a method of blasting a mass via an array of longitudinal drillholes into the mass, which method includes creating a zone of weakness of lesser density than neighbouring material of the mass, the zone being of limited longitudinal extent and being parallel to and closely spaced from a bank of material to be mined, so that the zone inhibits the propagation of shock waves across it, protecting the bank of material from damage during blasting.

The invention extends yet further to a method of blasting a mass which method includes the steps of providing a blasting arrangement with horizontal drillholes having their blind ends in a horizontal plane as herein described, so that the desired interface corresponds generally to a level of desired bench floor to be established by blasting; and detonating the blasting charge in each of the drillholes to displace each solid movable obstruction toward its associated blind end.

The invention, by way of development, extends to a method of mining which includes blasting as herein described.

The invention will now be described by way of example with reference to the accompanying diagrammatic drawings.

Figure 1:
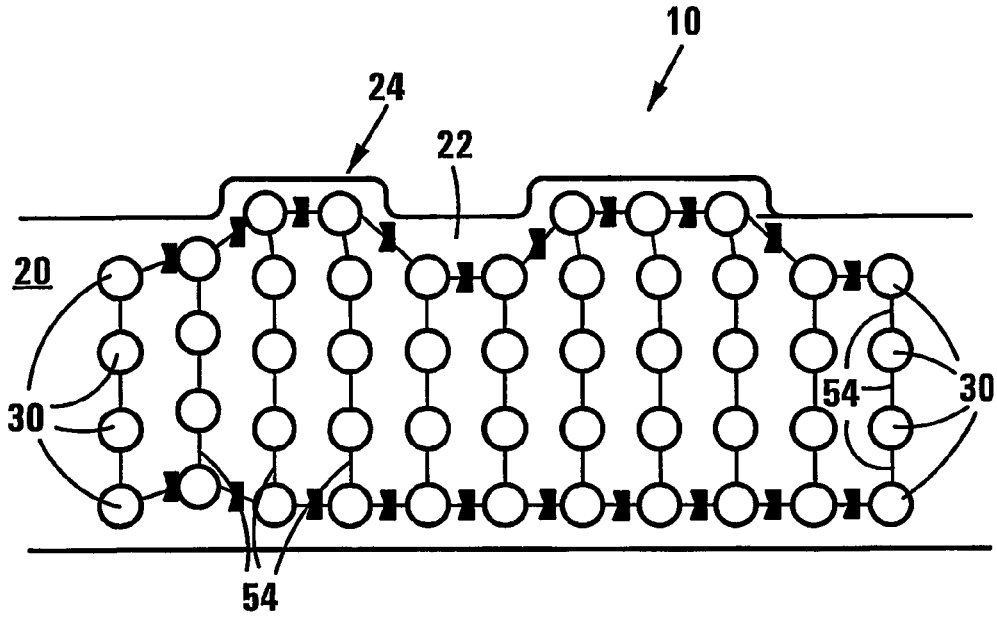
FIG. 1 is a plan view of a blasting arrangement formed by a plurality of drillhole arrangements in accordance with the invention, applied to the mining of ore.

In FIG. 1 of the drawings, reference numeral 10 generally refers to a blasting arrangement in accordance with the invention. The blasting arrangement 10 described in this example is a technical trial of the invention carried out by the Applicant. The trial was conducted in a copper mine in which parts of a rock mass 20 rich in ore are fragmented. The rock mass 20 is fragmented by blasting a portion of the rock mass 20, referred to as a block 22, at a time. To ensure stability of walls bordering a cavity created by fragmentation of each block 22, as well as to create a level working surface for carrying out successive blasts, each block 22 is fragmented only to a predetermined level, referred to as a bench floor.

Figure 2:
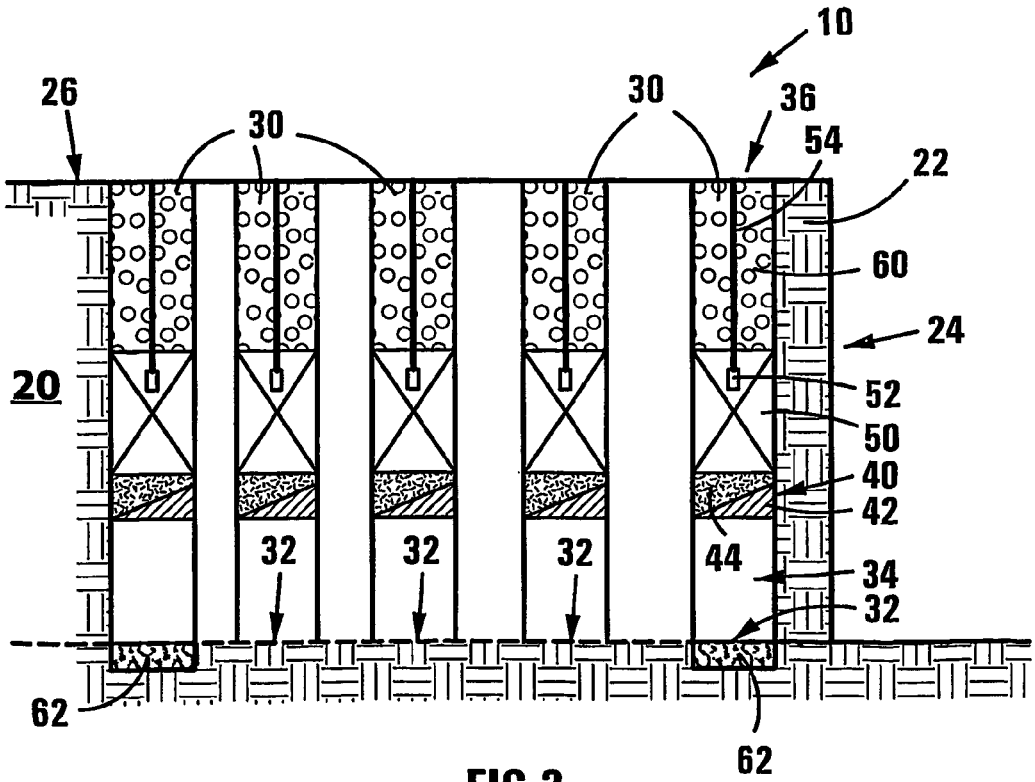
FIG. 2 is a sectional elevational view of the blasting arrangement of FIG. 1.

The blasting arrangement 10 included an array of vertical, cylindrical drillholes 30 drilled into the block 22 of the rock mass 20 to be fragmented. The drillholes 30 were arranged in a grid-like configuration adjacent to a free wall 24 in the rock mass 20. The drillholes 30 were drilled to such a depth that a blind end 32 of each of the drillholes 30 was located at a desired interface between the part of the rock mass 20 to be fragmented (the block 22) and the remainder of the rock mass 20. In this case, the desired interface is located at the level of the desired bench floor. Some of the drillholes 30 which were inadvertently drilled too deep, were backfilled with a layer of backfill material 62, in this case drill cuttings, so that the blind ends 32 of all of the drillholes 30 were located at a desired bench floor level (shown in dotted lines in FIGS. 2 and 3), in this example 14 meters from an upper surface 26 of the block 22.

Each drillhole 30 was plugged or obstructed, as shown at 40, by locating an obstruction at a position about one meter from the blind end 32 of each drillhole 30. The obstruction included a plug 42 of a resiliently flexible polymeric material which sealed the drillhole 30 such that the flow of air around the plug 42 was greatly inhibited. The plug 42 that was used in this trial was a resiliently flexible plug 42 such as that described in WO 99/61864. It will be appreciated that the drillhole 30 may also be plugged by a metal plate, masonry, a ceramic body, or by any other means that would result in compression or displacement of a fluid located between the obstruction 30 and the blind end 32 of the drillhole 30 upon detonation of explosives located above it. Insertion of the plug 42 into the drillhole 30 created a pressure chamber 34 between the plug 42 and the blind end 32 of the drillhole 30. In this case, the pressure chamber 34 was filled with air.

A non-flammable protective buffer was located above each plug 42 by tamping a layer of drill cuttings 44 into the drillhole 30 immediately above the plug 42 to a height of about 0.5 meters. An explosive 50 in the form of BLENDEX 930 was charged into the drillhole 30 immediately above the drill cuttings 44, the drill cuttings 44 and explosive 50 being suspended by the plug 42. The height of the column of explosive 50 was about 5.5 meters for each drillhole 30, with each charge of explosive 50 being provided with a detonator 52. The detonators 52 were connected by means of a detonator cord 54 and connectors, in this case THP 65 ms and which are not shown in the drawings, while a number of the drillholes 30 were provided with in hole delays (not shown). A portion of each drillhole 30 between the explosive 50 and an open end 36 was filled with a stemming material in the form of gravel 60. This served to inhibit the so-called "chimney effect", i.e. the loss of blast energy through the open end 36 of the drillhole 30 during blasting.

Figure 4:
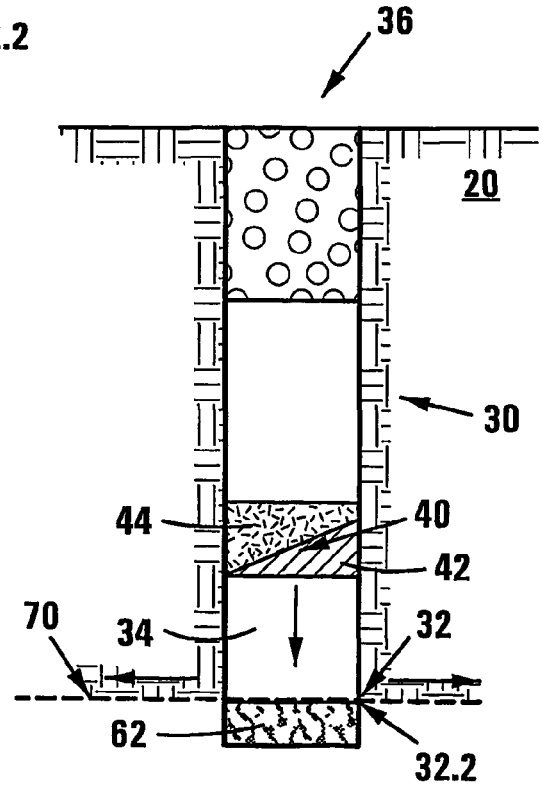
FIG. 4 is a view corresponding to FIG. 3, shortly after detonation of a blasting charge forming part of the drillhole arrangement.
Figure 5:
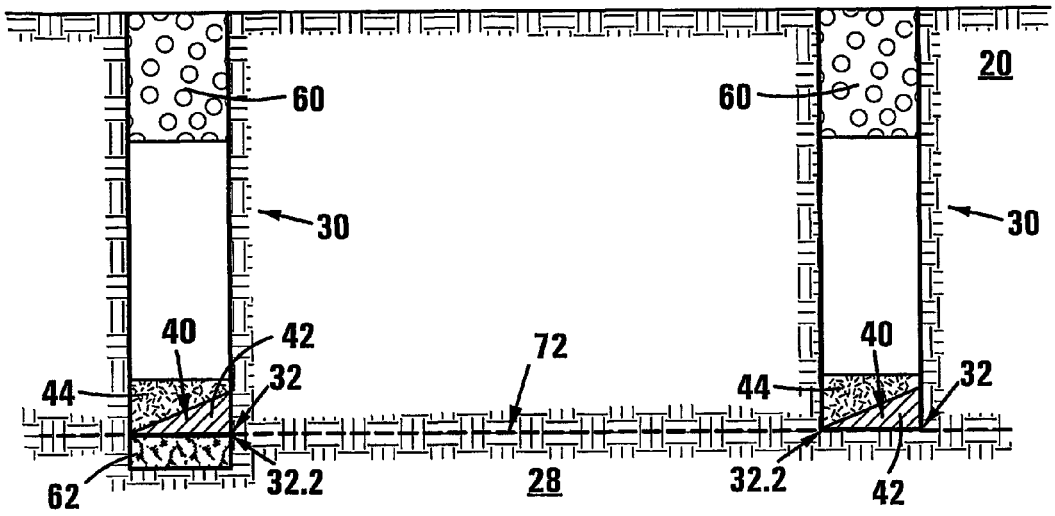
FIG. 5 is a sectional elevational view of two neighbouring drillhole arrangements forming part of the blasting arrangement of FIG. 1, following detonation of the blasting charges.

Upon detonation of the explosive 50 (shown in FIG. 4), each of the plugs 42, protected by its layer of drill cuttings 44, was forced downwards to close its associated pressure chamber 34 at a high velocity. Air in the pressure chamber 34 was compressed and exerted a heightened force on the portion of each drillhole 30 immediately surrounding it. The weakest part of this portion is the peripheral edge 32.2 of the circular bottom, or blind end 32 of the drillhole 30. As the plug 42 was propelled further downwards, the compressed air stressed or split the rock 20 at the edge 32.2 of the bottom 32 of each drillhole 30, causing a three-dimensional zone of weakness to form at this level. The air was forced into the zone of weakness by the still descending plug 42, causing a substantially horizontal fracture zone 70 in the rock mass 20 to form radially outwardly from the blind end 32 of each drillhole 30. The fracture zones 70 created by adjacent drillholes propagated towards one another and joined or integrated to form an encompassing fracture zone 72 in the rock mass (shown in FIG. 5). Since the fractures zones 70 caused by neighbouring drillholes 30 were at the same level, the integral fracture zone 72 formed a roughly planar bench floor at the desired level.

The creation of the horizontal fracture zone 72 inhibited the propagation of shock waves created by the blast from descending into an underlying rock mass 28, resulting in its remaining intact. Deflection of these shock waves from the integral fracture zone 72 toward the block 22 led to the creation of a concentrated destructive wave pattern within the block 22.

The result of the blast was that the bench floor was created by the horizontal fracture zone 72 almost exactly at the level of the blind ends 32 of the drillholes 30, which was the desired interface. The floor was at least as smooth as is achieved with conventional blasting methods, presented no toes, and was sufficiently firm. A back wall (not shown) which was formed due to the blast was sound and had no back breaks or toes. No ejection was observed during the blast and heave was relatively low, with an average of one meter. The fragmentation of the rock 20 above the bench floor was superior to that which is attained with conventional methods.

The Applicant believes that it is an advantage of the invention in this application that the bench floor can be established at the level of the blind ends 32 of the drillholes 30. This eliminates the need for sub-drilling, i.e. drilling the drillholes 30 deeper than the level of the desired bench floor, which is used with conventional methods of blasting. This leads to obvious savings with regard to drilling costs. Furthermore, the bench floor is smoother than is the case with conventional methods of blasting, while the fragmented block shows a higher degree of fragmentation. It was also established that less explosives are needed to attain a comparable degree of fragmentation.

Figure 6:
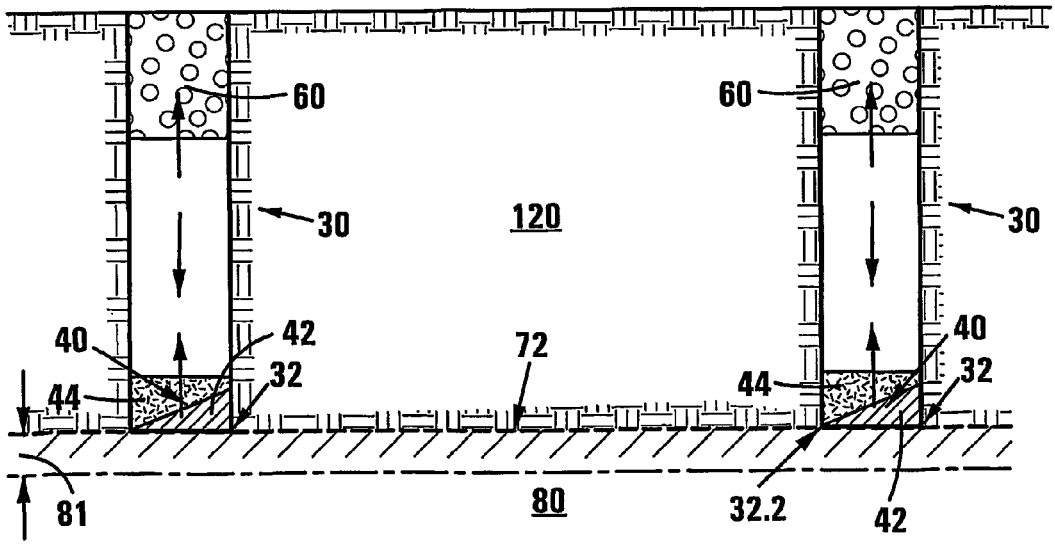
FIG. 6 is a sectional elevational view of two neighbouring drillhole arrangements forming part of a blasting arrangement similar to the blasting arrangement of FIG. 1, applied to the mining of coal, after the detonation of blasting charges forming part of the blasting arrangement.

FIG. 6 shows a further trial conducted by the Applicant, wherein a method of blasting in accordance with the invention was applied to the mining of coal. Features and components are numbered like in earlier figures. The blast was conducted according to a method similar to that discussed with reference to FIGS. 1 to 5 of the drawings, with the exception that the blind ends 32 of the drillholes 30 were provided at a level of about 30 cm (shown at 81) above a bank of material to be mined, in this instance a coal seam 80. A part of a rock mass 120 which overlies the coal seam 80 and is to be fragmented, is referred to as the overburden. Again, the blind ends 32 of drillholes 30 which were inadvertently drilled too deep, were adjusted by tamping a layer of drill cuttings into the respective drillholes. The hardness of the rock 120 varied between 80 mpa and 230 mpa for different strata in the mass. Detonation of the charge of explosive 50 in each of the drillholes 30 again caused a horizontal fracture zone 72 to form at the level of the blind ends 32 of the drillholes 30. The horizontal fracture zone 72 protected the coal seam 80 from blast damage, and there was hardly any over burden penetration into the seam 80.

The Applicant believes that the invention as described in this application provides a number of advantages over conventional blasting methods. The method of blasting conventionally used to expose a bank of material to be mined prevents the drillholes from being drilled such that the blind ends of the drillholes are close to the seam, as the seam is then damaged upon blasting, with some of the overburden material penetrating the seam. To avoid this, the drillhole is drilled to a depth of about 2 meters to 3 meters above the seam. Although this prevents damage to the seam, it leaves a hard bottom layer which has to be removed by secondary blasting. The method of blasting in accordance with the invention overcomes these difficulties by creating the horizontal fracture zone 72 on or close to the seam 80. This fracture zone 72 protects the seam 80 from blast damage by inhibiting the propagation of shock waves caused by the blast across it. It also deflects some of the shock waves back toward the overburden 120, resulting in a shock wave pattern that is more destructive than that which is achieved with conventional methods of blasting. Consequently, a smaller amount of explosive 50 is required, while expenses related to secondary blasting are eliminated. The fact that a smaller amount of explosives 50 can be used also results in the blast having a reduced environmental impact.

In subsequent trials, the Applicant has found that it is possible to position the blind ends 32 of the drillholes 30 almost exactly at an uppermost level of the coal seam 80, without causing damage to the seam 80 during blasting. It will also be appreciated that if the pressure chamber 34 is filled with water, it does not affect the functioning of the blasting arrangement.

Figure 7:
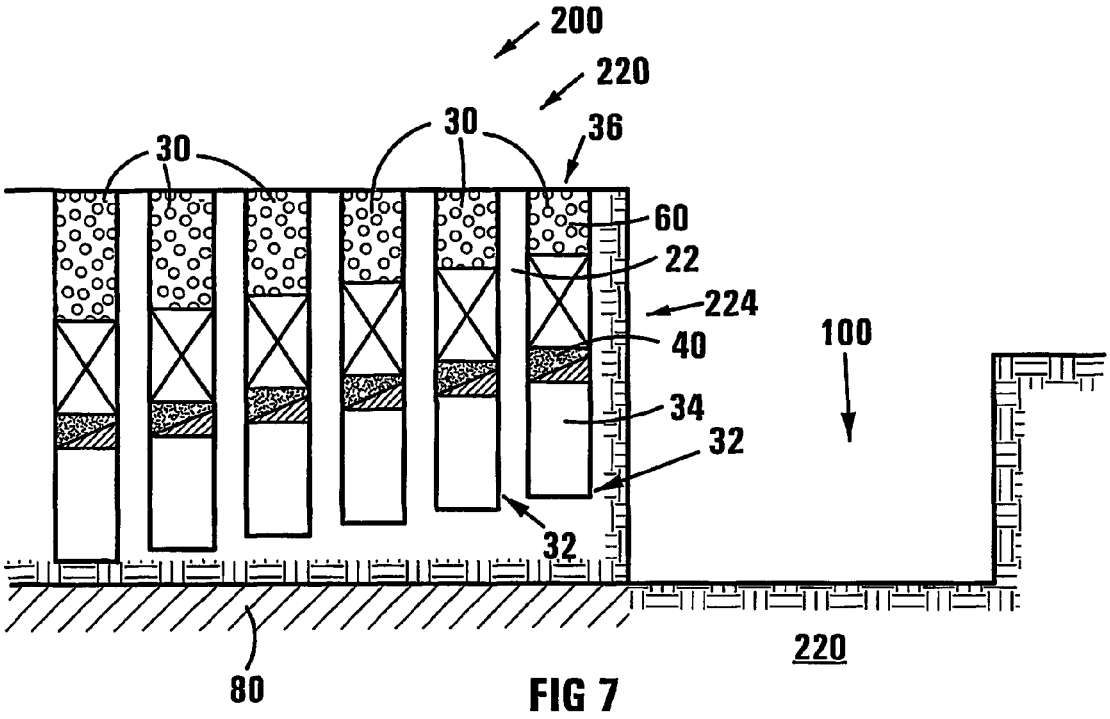
FIG. 7 is a sectional elevational view of a blasting arrangement, in accordance with the invention, for applying cast blasting in the mining of coal.

FIG. 7 shows, at 200, a further application of a method of blasting in accordance with the invention, with like reference numerals indicating like parts or features. The method is applied, for example, to the mining of coal wherein a block 22 of a rock mass 220 is simultaneously fragmented and displaced from a position where it overlies a coal seam 80 by means of a cast shot. The drillholes 30 are provided in the block 22 in a manner similar to that explained with reference to FIGS. 1 to 5. The block 22 is to be cast towards an adjacent cavity 100 in the rock mass 220 having a bench floor at a level equal to the desired bench floor for the block 22 to be blasted, a side of the block 22 facing the cavity forming a free wall 224. In this application, the blind ends 32 of the drillholes 30 are not all located on the level of the desired bench floor. Instead, the blind ends 32 lie in an inclined plane, with a spacing between the blind ends 32 and the seam 80 decreasing progressively with an increase in distance from the free wall 24.

The charges of explosives 50 are also not detonated simultaneously, but the detonation of the explosives 50 in successive rows of a grid in which the drillholes 30 are arranged are progressively delayed with increased spacing from the free wall 224 so that a row of drillholes adjacent the free wall 224 is detonated first. This results in the block 22, after fragmentation, being cast towards the cavity 100. The blind ends 32 of the drillholes 30 lie in an inclined plane to inhibit propelled rock 22 from impinging on the coal seam 80 during the blast, damaging it. This is further inhibited by the establishment of a fracture (not shown) in the rock mass in the plane of the blind ends 32 of the drillholes 30 in a manner similar to that explained above.

The Applicant believes that the use of a blasting arrangement 200 in accordance with the invention in this application leads to a reduction in the amount of explosive 50 required, an increase in the percentage and distance of material cast by the blast, and a reduction of damage to the coal seam 80.

Figure 3:
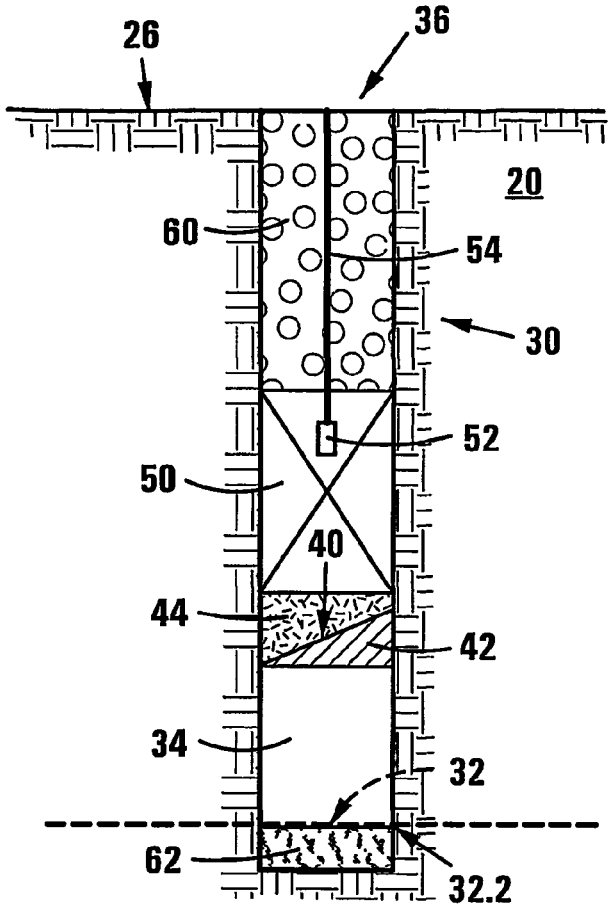
FIG. 3 is a sectional elevational view, to an enlarged scale, of a drillhole arrangement forming part of the blasting arrangement of FIG. 1.
Figure 8:
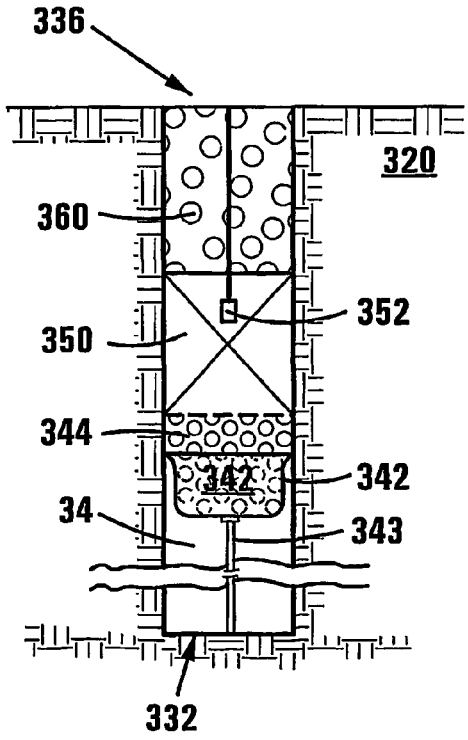
FIG. 8 corresponds generally to FIG. 3, but shows another embodiment of a solid, movable, obstruction.

With reference to FIG. 8, in a drillhole arrangement similar to that of FIG. 3 and in which like features and components are numbered alike, the solid movable obstruction is in the form of a hollow, flared, cup-like plunger 342, and a rigid but flimsy stem 343 projects from a bottom of the plunger 342. The length of the stem 343 is predetermined to hold the plunger 342 in an elevated position spaced above a bottom of the drillhole by a desired amount. A rim of the plunger 342 is flexible and is flared to render the plunger 342 snug fitting in and movable along the drillhole.

In use, the plunger 342 is dropped into the drillhole, a free end of the stem 343 leading. A buffer material, such as drill cuttings 344, is provided in and above the plunger 342 to protect it against destruction when an explosive 350 is initiated. When the plunger 342 is driven toward the bottom of the drillhole, the stem 343 fractures without imp ding travel of the plunger significantly.

The plunger 342 and stem 343 provide a neat and elegant solid, movable obstruction which can easily be positioned in the drillhole at a predetermined spacing from the bottom.

It will be appreciated that the method of blasting as described herein can be used advantageously in other instances where a part of a material mass is to be fragmented while leaving a remaining part of the mass intact, such as during demolition of a part of a man-made structure, or during blasting to establish a tunnel in a rock mass. In any of these cases, the blind ends 32 of the drillholes 30 together define a desired shape and position of an interface between the part of the mass to be fragmented and the remainder of the mass, with fractures zones 70 formed by adjacent drillholes 30 connecting to form the desired interface. It is also to be understood that the zone of weakness established initially during blasting need not be planar, but can be of virtually any shape dictated by the arrangement of blind ends of the drillholes, e.g. vault-shaped.

Although the Applicant does not wish to be bound by theory, the Applicant believes that the mechanism underlying this invention is the creation, initially during blasting, of a zone of lesser density than the surrounding mass, i.e. a zone of weakness, against which propagation of shock waves is checked and reflected or deflected. Thus, the blasting effect is concentrated to one side of such a zone of weakness. This has two main beneficial effects, first, concentration of the blasting energy in a confined volume leading to more effective use of the blast energy, and secondly, shielding of the mass beyond the zone of weakness from the blasting effect to leave such mass largely intact.

Some secondary advantages of using less explosive are reduced "chimney-effect", i.e. reduced discharge through the mouth of the drillhole;

reduced "heave, i.e. reduced upward displacement of the surface of the substrate in which blasting takes place;

reduced external blast effect.

It is important to appreciate the advantage of a "clean" and smooth interface corresponding to the zone of weakness. Such interface is neat, convenient, can be well-defined in respect of its level or position, and is conducive to safety in that "dry" holes are much more apparent compared to conventional blasting.

What is claimed is:

1. A method of blasting a mass via a longitudinal drillhole into the mass and having a blind end at a predetermined longitudinal position in the mass, the method including concentrating the blast between a mouth of the drillhole and an area laterally around the drillhole at the longitudinal position of the blind end by creating a zone of weakness of lesser density than neighbouring material of the mass, by obstructing the drillhole by means of a solid movable obstruction capable of acting as a plunger or piston and being spaced from the blind end and by driving the solid movable obstruction by blasting toward the blind end.

2. A method of blasting a mass including drilling a hole into the mass to have a blind end at a predetermined longitudinal position;

obstructing the drillhole by means of a solid, movable obstruction, which is capable of acting as a plunger or piston, at a position spaced from the blind end at a predetermined spacing;

charging the drillhole with a blasting charge toward an end of the solid, movable obstruction remote from the blind end;

tamping the drillhole; and detonating the blasting charge to cause the obstruction to be driven toward the blind end.

3. A method of blasting as claimed in claim 2, which includes providing a protective buffer between the obstruction and the blasting charge.

4. A method of blasting as claimed in claim 2, which includes the step of adjusting the blind end of the drillhole to said predetermined longitudinal position by backfilling the drillhole with a backfill material when it was drilled excessively deeply.

5. A drillhole arrangement in a mass which includes a drillhole in the mass and having a blind end at a predetermined longitudinal position;

a solid movable obstruction which is spaced from the blind end;

a blasting charge located to an end of the solid movable obstruction remote from the blind end; and tamping material obstructing a portion of the drillhole between the blasting charge and a mouth of the drillhole, in which the solid movable obstruction is capable of acting as a plunger or piston to compress or displace fluid between the obstruction and the blind end upon detonation of the blasting charge.

6. A drillhole arrangement as claimed in claim 5, wherein a spacing between the obstruction and the blind end is between about 0.1 m and about 3 m.

7. A drillhole arrangement as claimed in claim 5, wherein the solid movable obstruction is a moulding of a resiliently flexible polymeric material.

8. A drillhole arrangement as claimed in claim 5, which includes a protective buffer located between the solid movable obstruction and the blasting charge, wherein the protective buffer is a layer of a non-flammable protective material.

9. A drillhole arrangement as claimed in claim 5, in which the drillhole was drilled excessively deeply and has an initial end beyond said predetermined longitudinal position, the arrangement including a layer of backfill material against said initial end of the drillhole, so that a free end of the layer of backfill material proximate the obstruction effectively forms the blind end of the drillhole.

10. A drillhole arrangement as claimed in claim 5, wherein at least a portion of the drillhole between its blind end and the movable obstruction is filled with a liquid.

11. A blasting arrangement which includes an array of spaced drillhole arrangements as claimed in claim 5, with the blind ends of the drillholes lying on a predetermined interface between a part of the mass to be fragmented and a part of the mass which is to remain generally intact after detonation of the blasting charges.

12. A blasting arrangement as claimed in claim 11, wherein the drillholes are substantially parallel and the predetermined interface lies generally in a plane transverse to the drillholes.

13. A blasting arrangement as claimed in claim 12, wherein the drillholes are substantially vertical, and the predetermined interface is substantially horizontal.

14. A blasting arrangement as claimed in claim 11, wherein the predetermined interface is generally parallel to and is closely spaced from a bank of material which is to be left intact.

15. A blasting arrangement as claimed in claim 13, wherein the predetermined interface is located at a level corresponding to a level at which a desired bench floor is to be established during blasting.

16. A blasting arrangement as claimed in claim 11, wherein the drillholes are arranged in a grid-like configuration.

17. A blasting arrangement as claimed in claim 11, which arrangement is provided in an underground mining working.

18. A method of blasting a mass as claimed in claim 2 to fragment a part of the mass while leaving a remaining part of the mass generally intact, which method includes the step of establishing a zone of weakness of lesser density than neighbouring material of the mass, the zone being of limited longitudinal extent, coinciding generally with a desired interface between the pan of the mass to be fragmented and the remaining part, and extending transversely to each of an array of spaced boreholes, so that the blast is concentrated between the zone and the mouths of the boreholes.

19. A method of blasting which includes the steps of providing a blasting arrangement as claimed in claim 11; and detonating the blasting charge in each of the drillholes to displace each solid movable obstruction toward its associated blind end.

20. A method of blasting as claimed in claim 19, wherein the drillholes are substantially vertical, the pan of the mass to be fragmented defines a substantially vertical free face facing a receiving cavity in the mass, and detonation of the blasting charges is progressively delayed with an increase in distance of each blasting charge from the free face, causing the part of the mass in which the blasting arrangement is provided to be cast towards the receiving cavity.

21. A method of blasting a mass including carrying out the method of claim 2 in each of an array of longitudinal drillholes into the mass, which method includes creating a zone of weakness of lesser density than neighbouring material of the mass, the zone being of limited longitudinal extent and being parallel to and closely spaced from a bank of material to be mined, so that the zone inhibits the propagation of shock waves across it, protecting the bank of material from damage during blasting.

22. A method of blasting a mass which method includes the steps of providing a blasting arrangement as claimed in claim 13, so that the desired interface corresponds generally to a level of a desired bench floor to be established by blasting; and detonating the blasting charge in each of the drillholes to displace each solid movable obstruction toward its associated blind end.

23. A method of mining which includes blasting a mass in accordance with a method of blasting a mass as claimed in claim 18.

* * * * *